US011976827B2

(12) United States Patent
Iwazaki et al.

(10) Patent No.: US 11,976,827 B2
(45) Date of Patent: May 7, 2024

(54) OUTDOOR UNIT AND AIR CONDITIONER

(71) Applicant: Mitsubishi Electric Corporation, Tokyo (JP)

(72) Inventors: Kenji Iwazaki, Tokyo (JP); Koichi Arisawa, Tokyo (JP); Takuya Shimomugi, Tokyo (JP); Keisuke Mori, Tokyo (JP); Yuya Kondo, Tokyo (JP); Satoru Ichiki, Tokyo (JP); Keisuke Uemura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 605 days.

(21) Appl. No.: 17/265,985

(22) PCT Filed: Aug. 9, 2018

(86) PCT No.: PCT/JP2018/029912
§ 371 (c)(1),
(2) Date: Feb. 4, 2021

(87) PCT Pub. No.: WO2020/031327
PCT Pub. Date: Feb. 13, 2020

(65) Prior Publication Data
US 2021/0293419 A1 Sep. 23, 2021

(51) Int. Cl.
*F24F 1/16* (2011.01)
*F24F 1/24* (2011.01)
(Continued)

(52) U.S. Cl.
CPC ..... *F24F 1/16* (2013.01); *F24F 1/24* (2013.01); *F24F 1/48* (2013.01); *F24F 1/56* (2013.01); *F24F 11/88* (2018.01)

(58) Field of Classification Search
CPC ..... F24F 1/16; F24F 1/24; F24F 1/48; F24F 1/56; F24F 11/88; F24F 1/38
See application file for complete search history.

(56) References Cited

U.S. PATENT DOCUMENTS 9,353,968 B2 * 5/2016 Hayakawa ..... F24H 3/022
2013/0255298 A1 * 10/2013 Amano ..... F24F 1/24 62/186

FOREIGN PATENT DOCUMENTS

CN 105934635 A * 9/2016 ..... F24F 1/22
CN 106839164 A * 6/2017 ..... F24F 1/24
(Continued)

OTHER PUBLICATIONS

Office Action dated Oct. 9, 2021, issued in corresponding CN Patent Application No. 201880096158.X (and English Machine Translation).

*Primary Examiner* — Kun Kai Ma
(74) *Attorney, Agent, or Firm* — POSZ LAW GROUP, PLC

(57) ABSTRACT

An outdoor unit includes a housing, a heat exchanger, an electric component box, a substrate, and a heat dissipator including multiple fins. The fins each have a first end situated in a windward side of an air passage formed between adjacent ones of the fins, and the first end faces the electric component box. When the heat dissipator and the electric component box are viewed from above, a first clearance gap having a first width and a second clearance gap having a second width greater than the first width are formed between the first end and the electric component box. The second clearance gap is situated closer to a back panel than the first clearance gap.

20 Claims, 9 Drawing Sheets

(51) Int. Cl.

| | |
|---|---|
| ***F24F 1/48*** | (2011.01) |
| ***F24F 1/56*** | (2011.01) |
| ***F24F 11/88*** | (2018.01) |

(56) References Cited

FOREIGN PATENT DOCUMENTS

| | | | | | |
|---|---|---|---|---|---|
| CN | 106931541 | A | * | 7/2017 | |
| JP | H0719531 | A | * | 1/1995 | |
| JP | 2005-069584 | A | | 3/2005 | |
| JP | 2014044007 | A | * | 3/2014 | ..... F24F 1/22 |

* cited by examiner

OUTDOOR UNIT AND AIR CONDITIONER

CROSS REFERENCE TO RELATED APPLICATION

This application is a U.S. national stage application of International Patent Application No. PCT/JP2018/029912 filed on Aug. 9, 2018, the disclosure of which is incorporated herein by reference.

TECHNICAL FIELD

The present invention relates to an outdoor unit having a heat dissipator and to an air conditioner each including.

BACKGROUND

Patent Literature 1 discloses a technique for reducing turbulence of a flow of air flowing near a blower included in an outdoor unit thereby to reduce noise caused by the turbulence of the flow of air. The outdoor unit disclosed in Patent Literature 1 includes a housing, a blower, a compressor, and a partition plate. The partition plate is a member that separates a blower chamber where the blower is disposed and a compressor chamber where the compressor is disposed. A heat exchanger is provided on the rear side of the housing, and an electric component box is installed in front of this heat exchanger in a manner that the box faces the heat exchanger. The electric component box is disposed on a surface of the partition plate on the heat exchanger side. Inside the electric component box, a substrate is provided, on which electric components are mounted for driving the compressor and the blower. A heat dissipator for cooling the electric components is provided in a space between the heat exchanger provided on the rear side of the housing and the electric component box. In addition, the heat dissipator is disposed in a space between the compressor chamber and the top panel of the housing. The heat dissipator includes a base in contact with the electric components, and multiple fins formed on the base and arranged spaced apart from each other. The multiple fins each have a leading edge facing the heat exchanger provided on the rear side of the housing. The multiple fins are arranged spaced apart from each other in a direction from the top panel toward a bottom panel of the housing, i.e., in the vertical direction.

The outdoor unit disclosed in Patent Literature 1 is provided with the heat dissipator between the heat exchanger provided on the rear side of the housing and the electric component box disposed in front thereof. Therefore, no heat exchanger exists in a space immediately above the blower and in a space behind the blower, thereby reducing turbulence of air flowing near the blower, and thus reducing noise caused by the turbulence of a flow of air.

PATENT LITERATURE

Patent Literature 1: Japanese Patent Application Laid-open No. 2005-69584

The outdoor unit disclosed in Patent Literature 1 is provided with the electric component box in a space between the compressor chamber and the top panel of the housing, and with the heat dissipator in a space between the heat exchanger disposed on the rear side of the housing and the electric component box. Thus, in order to improve cooling efficiency of the heat dissipator without an increase of the rotational speed of the blower, the surface area of the fins needs to be increased by increasing a width from the leading edge of the fin to the back panel of the housing, or by increasing a width from the compressor chamber to the top panel of the housing. Accordingly, the size of the housing increases with an increase in surface area of the fins, which in turn presents a problem in difficulty in size reduction of the housing while improving the cooling efficiency of the heat dissipator.

SUMMARY

The present invention has been made in view of the foregoing circumstances, and it is an object of the present invention to provide an outdoor unit capable of achieving a size reduction of the housing while improving the cooling efficiency of the heat dissipator.

In order to solve the above-mentioned problem and achieve the object, the present invention provides an outdoor unit comprising: a blower to generate an airflow; a housing having a front panel, a back panel, a first side panel, a second side panel, a top panel, and a bottom panel, the front panel having an outlet through which the airflow passes, the back panel being situated on an opposite side of the front panel, the second side panel being situated on an opposite side of the first side panel, the bottom panel being situated on an opposite side of the top panel, the blower being disposed in the housing; a heat exchanger provided to a rear side of the housing; an electric component box provided between the heat exchanger and the front panel; a substrate having an electric component provided thereon, the substrate extending from the electric component box toward the second side panel; and a heat dissipator provided between the electric component box and the blower, and thermally connected to the electric component provided on the substrate, the heat dissipator comprising a plurality of fins that are arranged spaced apart from each other in a direction from the front panel to the back panel, an air passage being formed between adjacent ones of the fins, the fins each having an end situated on a windward side of the air passage, the end facing the electric component box, wherein when the heat dissipator and the electric component box are viewed from above, a first clearance gap having a first width and a second clearance gap having a second width greater than the first width are formed between the end and the electric component box, the second clearance gap being closer to the back panel than the first clearance gap.

An outdoor unit according to the present invention provides an advantageous effect of capability of achieving a size reduction of the housing while improving the cooling efficiency of the heat dissipator.

DETAILED DESCRIPTION

An outdoor unit and an air conditioner according to embodiments of the present invention will be described in detail below with reference to the drawings. Note that these embodiments are not intended to necessarily limit the scope of this invention.

First Embodiment

Figure 1:
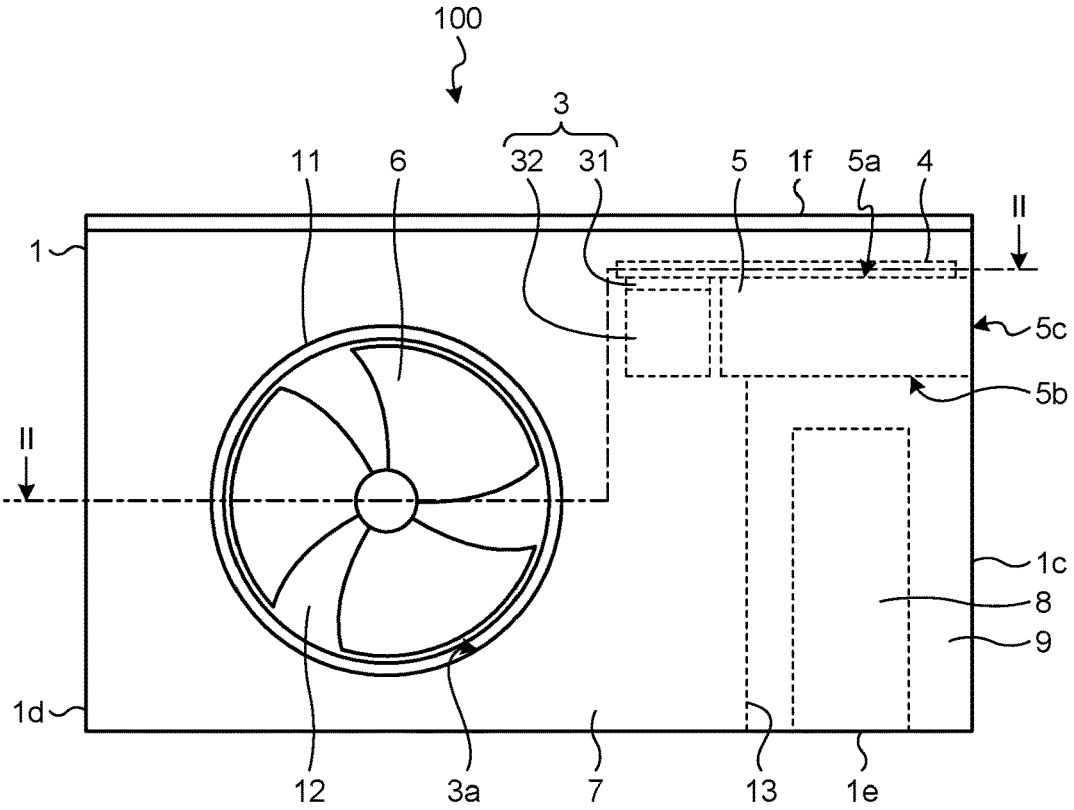
FIG. 1 is a front view of an outdoor unit according to a first embodiment of the present invention.
Figure 2:
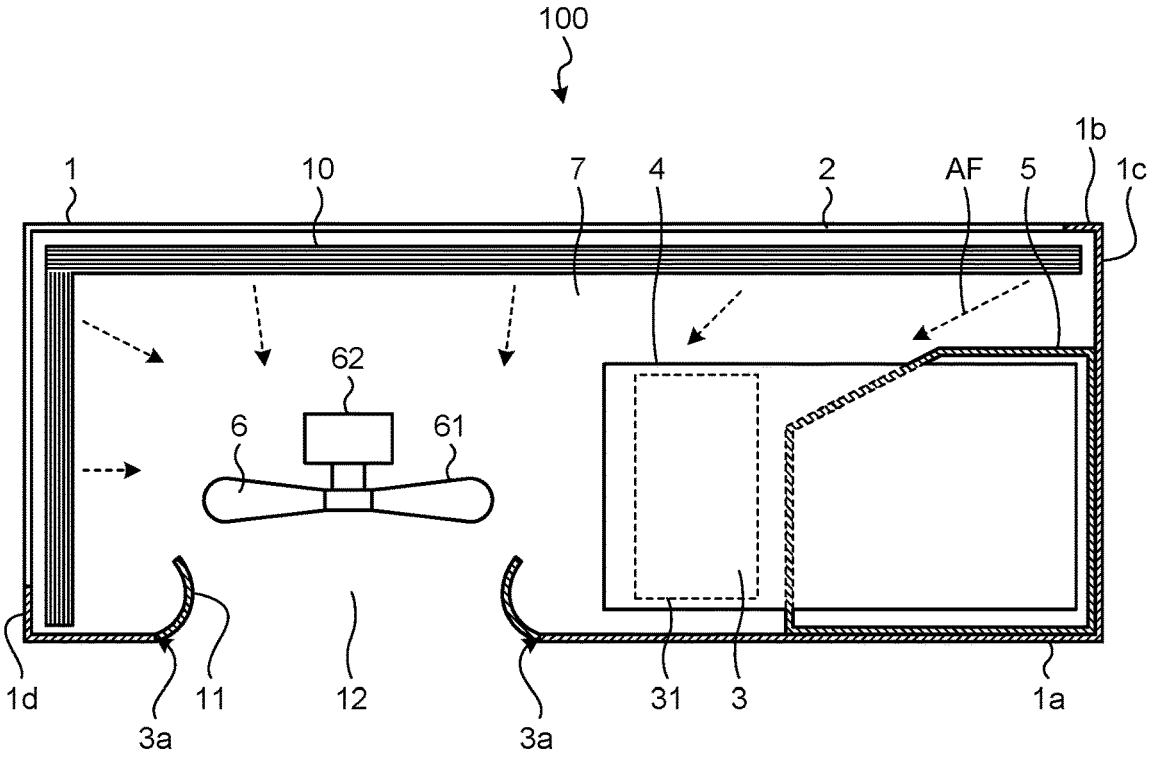
FIG. 2 is a cross-sectional view taken along a line II-II illustrated in FIG. 1.
Figure 3:
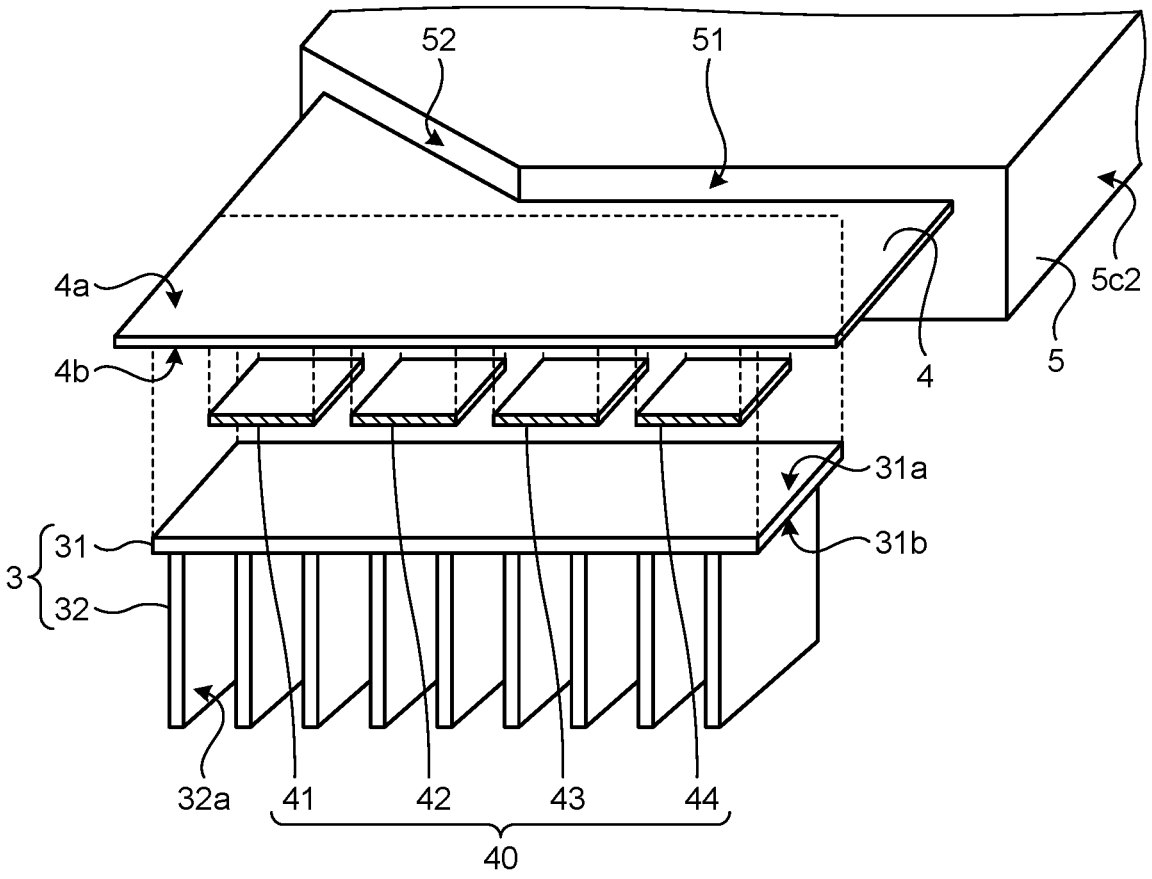
FIG. 3 is an enlarged perspective view schematically illustrating a heat dissipator illustrated in FIG. 1.
Figure 4:
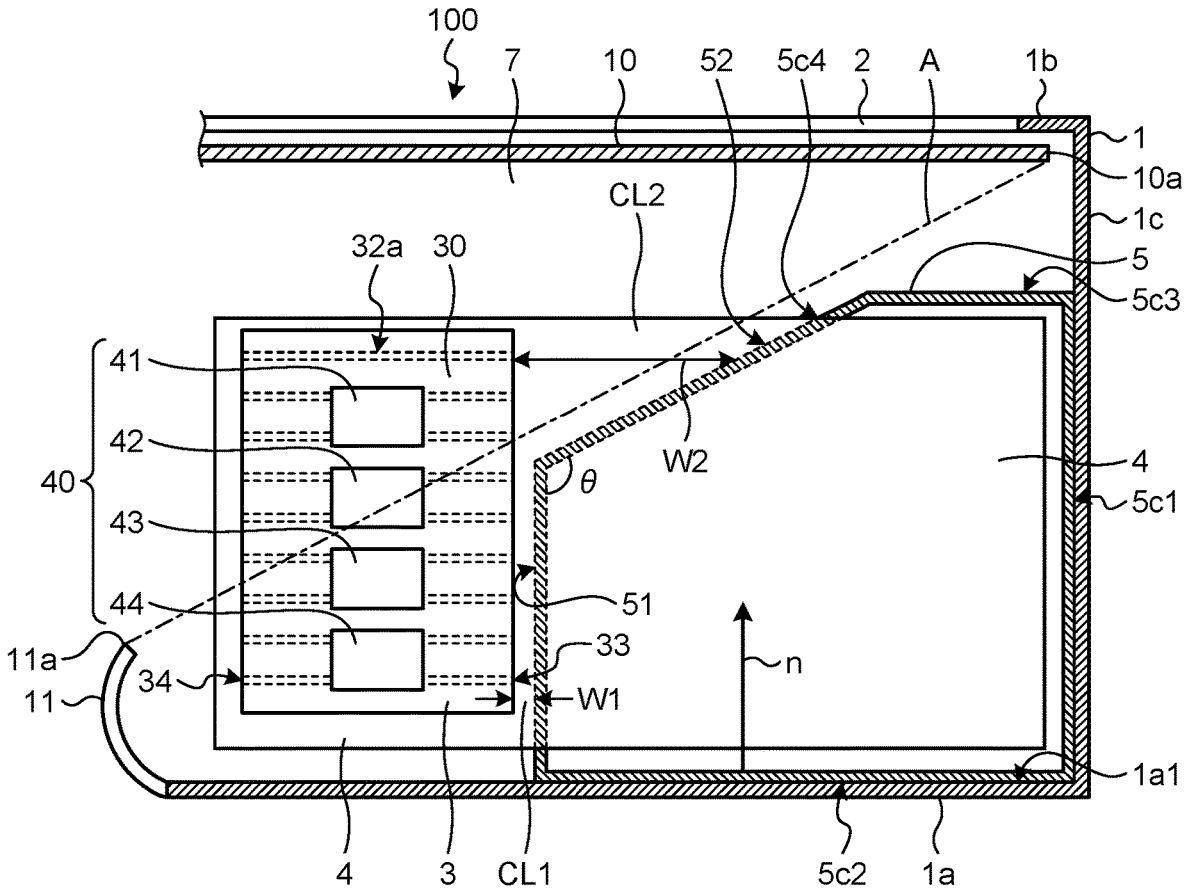
FIG. 4 is an enlarged perspective view schematically illustrating the heat dissipator and the electric component box illustrated in FIG. 2.

FIG. 1 is a front view of an outdoor unit according to a first embodiment of the present invention. FIG. 2 is a cross-sectional view taken along a line II-II illustrated in FIG. 1. FIG. 3 is an enlarged perspective view schematically illustrating a heat dissipator illustrated in FIG. 1. FIG. 4 is an enlarged perspective view schematically illustrating the heat dissipator and a electric component box illustrated in FIG. 2. An outdoor unit 100 is an outdoor unit in an air conditioner. The air conditioner transfers heat between room air and outdoor air to provide air conditioning of a room using a refrigerant circulating between the outdoor unit 100 and an indoor unit set in the room. FIG. 1 illustrates, using broken lines, a compressor 8, a partition plate 13, a substrate 4, a heat dissipator 3, and an electric component box 5 which are included inside a housing 1 of the outdoor unit 100. FIG. 2 illustrates, using broken lines, some part of the electric component box 5 and a base 31 of the heat dissipator 3 which are included inside the housing 1 of the outdoor unit 100.

The outdoor unit 100 includes the housing 1 forming an outer shell of the outdoor unit 100. The housing 1 is a box-shaped structure including a front panel 1*a*, a back panel 1*b*, a first side panel 1*c*, a second side panel 1*d*, a bottom panel 1*e*, and a top panel 1*f*, which are wall plates. The back panel 1*b* is a wall plate opposed to the front panel 1*a*. The second side panel 1*d* is a wall plate opposed to the first side panel 1*c*. The bottom panel 1*e* is a wall plate opposed to the top panel 1*f*. As illustrated in FIG. 2, an intake 2 is formed in the back panel 1*b* and the second side panel 1*d*. The front panel 1*a* has an outlet 12 having a round shape, formed therein. The outlet 12 is an opening for discharging the air taken inside the housing 1 through the intake 2 to the outside of the housing 1. The outlet 12 is defined by an annular wall surface 3*a*, and on the wall surface 3*a*, a bell mouth 11 is formed. The bell mouth 11 is an annular member projecting into the inside of the housing 1 from the wall surface 3*a*.

In the following description, a direction in which the front panel 1*a* of the housing 1 faces may be referred to as forward direction, while a direction opposite to the forward direction may be referred to as backward direction. In addition, the forward direction and the backward direction may be referred to collectively as forward-backward direction. The forward-backward direction is a direction perpendicular to a vertical direction that is a direction of gravitational force. Moreover, as viewed from the front of the outdoor unit 100, a left side of the outdoor unit 100 may be referred to as leftward direction, while a right side of the outdoor unit 100 may be referred to as rightward direction. In addition, the leftward direction and the rightward direction may be referred to collectively as lateral direction. The lateral direction is a direction perpendicular to both the vertical direction and the forward-backward direction. Furthermore, as viewed from the front of the outdoor unit 100, the upper side of the outdoor unit 100 may be referred to as upward direction. The first side panel 1*c* is a side plate on the right side which is one lateral side of the outdoor unit 100 as viewed from the front of the outdoor unit 100. The second side panel 1*d* is a side plate on the left side which is another lateral side of the outdoor unit 100 as viewed from the front of the outdoor unit 100.

The partition plate 13 is a member that separates a space inside the housing 1 into a blower chamber 7, which is a space in which a blower 6 is disposed, and a compressor chamber 9, which is a space in which the compressor 8 is disposed. The partition plate 13 is formed, when viewed from above, for example, to extend from the front panel 1*a* toward the back panel 1*b*, bend toward the first side panel 1*c* before reaching the back panel 1*b*, and come into contact with the first side panel 1*c*. Use of the partition plate 13 having such a shape causes the space between the partition plate 13 and the back panel 1*b* to serve as a part of the blower chamber 7. Therefore, an increase in the opening area of the intake 2 by extending the intake 2 formed in the back panel 1*b* of the housing 1 to a position near the first side panel 1*c* results in an increase in the amount of air to be taken inside the housing 1 through the intake 2. Accordingly, as compared to when the intake 2 is not extended to a position near the first side panel 1*c*, the amount of air passing through a heat exchanger 10 provided in a manner that the exchanger 10 covers the intake 2 is increased, and the amount of heat exchange between the refrigerant flowing through the heat exchanger 10 and the air passing through the heat exchanger 10 is increased. This increases operating efficiency of the outdoor unit 100. Note that the outdoor unit 100 may be configured such that the blower chamber 7 is formed on the side closer to the first side panel 1*c* with respect to the partition plate 13, and the compressor chamber 9 is formed on the side closer to the second side panel 1*d* with respect to the partition plate 13.

Inside the housing 1, the blower 6 is disposed within a region resulting from projection of the inner edge of the bell mouth 11 in a direction from the front panel 1*a* to the back panel 1*b* of the housing 1. The blower 6 includes an impeller 61 and a motor 62 that is a power source of the impeller 61. Operation of the motor 62 of the blower 6 to rotate the impeller 61 of the blower 6 causes air to be taken into the blower chamber 7 of the housing 1 from the outside of the housing 1 through the intake 2. The air taken into the blower chamber 7 is discharged into the outside of the housing 1 through the outlet 12. In FIG. 2, by broken-line arrows, an airflow AF generated in the inside of the housing 1 by rotation of the blower 6 are illustrated. The airflow AF is a flow of air taken from the outside of the housing 1 into the blower chamber 7 of the housing 1.

The heat exchanger 10 is provided inside the housing 1 in the state of the exchanger 10 covering the intake 2 formed in the housing 1. The heat exchanger 10 is disposed in the blower chamber 7, and faces the inner side of the back panel 1*b* and the inner side of the second side panel 1*d* of the housing 1. The heat exchanger 10 includes multiple heat-dissipating fins (not illustrated) arranged spaced apart from each other, and multiple pipes (not illustrated) provided in the state of the pipes penetrating the multiple heat-dissipating fins, the pipes allowing the refrigerant to flow therein.

The compressor chamber 9 is a space surrounded by the partition plate 13 and the first side panel 1*c*. Inside the compressor chamber 9, the compressor 8 that compresses the refrigerant is provided. The compressor 8 is connected to the multiple pipes (not illustrated) included in the heat exchanger 10. The refrigerant compressed by the compressor 8 is conveyed to these pipes. Passage of air through the heat exchanger 10 causes heat exchange between the refrigerant flowing in these pipes and the heat exchanger 10.

The electric component box 5 is disposed above the compressor chamber 9. Specifically, the electric component box 5 is disposed in a space formed between a top edge of the partition plate 13 forming the compressor chamber 9 and the top panel 1*f*.

As illustrated in FIG. 1, the electric component box 5 houses the substrate 4. The substrate 4 has a first substrate surface 4*a* and a second substrate surface 4*b* situated on the opposite side of the first substrate surface 4*a*. The first substrate surface 4*a* is a substrate surface closer to the top panel 1*f* illustrated in FIG. 1. The second substrate surface 4*b* is a substrate surface closer to the bottom panel 1*e* illustrated in FIG. 1. The substrate 4 is a plate-shaped member with the first substrate surface 4*a* being set parallel to the top panel 1*f* illustrated in FIG. 1. In FIG. 1, the substrate 4 is disposed such that a portion on the side of the first side panel 1*c* is situated inside the electric component box 5, and a portion on the side of the second side panel 1*d* protrudes outside the electric component box 5. In the example configuration illustrated in FIG. 3, a part of the substrate 4 of the entire substrate 4 is housed inside the electric component box 5, while the remaining part of the substrate 4 is exposed outside the electric component box 5. The portion exposed outside the electric component box 5, of the entire substrate 4 is disposed, as illustrated in FIG. 1, on a side closer to the blower chamber 7 with respect to the partition plate 13 as viewed from the front of the housing 1. In addition, a front end edge of the substrate 4 closer to the blower 6 is situated, as illustrated in FIG. 1, outside the region defined by projection of the bell mouth 11 in a direction from the bottom panel 1*e* to the top panel 1*f* of the housing 1.

The portion exposed to the outside of the electric component box 5, of the entire substrate 4 includes multiple electric components 40 as illustrated in FIG. 3. For clarification of arrangement relationship between the multiple electric components 40 and the substrate 4, FIG. 3 illustrates the multiple electric components 40 at a position apart from the substrate 4, but the multiple electric components 40 are, in fact, provided in contact with the substrate 4. The multiple electric components 40 are placed on the second substrate surface 4*b* of the substrate 4. The multiple electric components 40 include, for example, a first electric component 41, a second electric component 42, a third electric component 43, and a fourth electric component 44. The first electric component 41 is, for example, a semiconductor device, a reactor, and the like which constitute an inverter circuit for converting direct current (DC) power into alternating current (AC) power, and driving at least one of the compressor 8 and the blower 6. The second electric component 42 is a semiconductor device, a reactor, and the like which constitute a converter circuit for converting AC power supplied from a utility power supply into DC power, and outputting the DC power to the inverter circuit. The third electric component 43 and the fourth electric component 44 are each a component, the amount of heat generation of which is smaller than each of the first electric component 41 and the second electric component 42, that is, for example, a resistor for voltage detection, smoothing capacitor, or the like. Note that the number of the electric components 40 is not limited to four, but may be any number greater than or equal to one.

The multiple electric components 40 are each in contact with the heat dissipator 3 as illustrated in FIG. 3. The heat dissipator 3 is a component for cooling each of the multiple electric components 40. FIG. 3 illustrates the heat dissipator 3 at a position apart from the multiple electric components 40 for clarification of arrangement relationship between the multiple electric components 40 and the heat dissipator 3, but the heat dissipator 3 is, in fact, set in contact with the multiple electric components 40. The heat dissipator 3 may be fixed to the multiple electric components 40, or may be fixed to the substrate 4 or to the electric component box 5 using a fixing member (not illustrated) interposed therebetween.

The heat dissipator 3 has a width in the direction from the front panel 1*a* to the back panel 1*b* larger than a width in the direction from the first side panel 1*c* to the second side panel 1*d*. The heat dissipator 3 includes the base 31 and multiple fins 32. As illustrated in FIGS. 1 and 2, the base 31 is a plate-shaped member extending from the front panel 1*a* toward the back panel 1*b* of the housing 1, and extending from the first side panel 1*c* toward the second side panel 1*d* of the housing 1. As illustrated in FIG. 3, the base 31 has an upper surface 31*a* facing the multiple electric components 40.

The base 31 has a lower surface 31*b*, on which the multiple fins 32 are disposed. The multiple fins 32 are each a plate-shaped member extending toward a bottom side of the housing 1 from the lower surface 31*b* of the base 31. The multiple fins 32 are arranged spaced apart from each other in the direction from the front panel 1*a* to the back panel 1*b* illustrated in FIG. 2. As illustrated in FIG. 1, the multiple fins 32 are provided outside the electric component box 5, and disposed in the blower chamber 7.

The multiple fins 32 are each provided with a heat-dissipating surface 32*a* as illustrated in FIG. 3. The heat-dissipating surface 32*a* has, for example, a rectangular shape. Note that it is sufficient that the shape of the heat-dissipating surface 32*a* is a shape that allows efficient radiation of the heat that has been transferred from the multiple electric components 40 to the heat dissipator 3, and the shape of the heat-dissipating surface 32*a* is not limited to a rectangle. The heat-dissipating surface 32*a* of each of the fins 32 is parallel to the front panel 1*a* illustrated in FIG. 1. The heat-dissipating surfaces 32*a* forming counter-surfaces of adjacent fins 32 are parallel to each other. The heat-dissipating surfaces 32*a* of the adjacent fins 32 define an air passage that allows air to pass therethrough.

Shapes, arrangement positions, and the like of the electric component box 5 and the heat dissipator 3 will next be described. The electric component box 5 includes, as illustrated in FIG. 1, an upper surface 5*a* closer to the top panel 1*f*, a lower surface 5*b* opposed to the compressor 8, and a side surface 5*c*.

The side surface 5*c* of the electric component box 5 includes, as illustrated in FIG. 4, a first side surface 5*c*1 opposed to the first side panel 1*c* of the housing 1, a second side surface 5*c*2 opposed to the front panel 1*a* of the housing 1, a third side surface 5*c*3 opposed to the heat exchanger 10 provided to the back panel 1*b* of the housing 1, and a fourth side surface 5*c*4 opposed to the heat dissipator 3.

The fourth side surface 5*c*4 includes a first counter-surface 51 and a second counter-surface 52. The first counter-surface 51 extends from the front panel 1*a* toward the back panel 1*b* of the housing 1 in parallel with a normal n perpendicular to an inner surface 1*a*1 of the front panel 1*a* of the housing 1. The first counter-surface 51 has an end on the side of the back panel 1*b*, the end being connected with the second counter-surface 52. The second counter-surface 52 is a surface angled at a constant angle θ with respect to an extension direction of the normal n, i.e., an extension direction of the first counter-surface 51. In addition, the second counter-surface 52 of the electric component box 5 is situated closer to the front panel 1*a* of the housing 1 than a vertical cross section including an imaginary line A. The imaginary line A is, for example, a virtual line connecting most directly between an end 11*a* of the bell mouth 11 closer to the back panel 1*b* and an end 10*a* of the heat exchanger 10 closer to the first side panel 1*c*, the heat exchanger 10 being provided on the back panel 1*b* side of the housing 1.

As illustrated in FIG. 4, when the heat dissipator 3 and the electric component box 5 are viewed from above, a first clearance gap CL1 having a first width W1 and a second clearance gap CL2 having a second width W2 greater than the first width W1 are formed between first ends 33 of the multiple fins 32 and the fourth side surface 5*c*4 of the electric component box 5. The first ends 33 are portions opposed to the fourth side surface 5*c*4 of the electric component box 5. The first ends 33 are situated on a windward side of air passages 30. The air passages 30 are each a wind channel formed in a gap between the adjacent fins 32. Second ends 34 are portions of the fins 32 on a side opposed to the fourth side surface 5*c*4 side of the electric component box 5, and are situated on the leeward side of the air passages 30. The heat dissipator 3 illustrated in FIG. 4 has eight air passages 30 formed therein.

As illustrated in FIG. 4, the first clearance gap CL1 corresponds to, for example, a clearance gap formed between each of the first through sixth ones of the fins 32 as viewed from the front panel 1*a* to the back panel 1*b*, and the electric component box 5. The second clearance gap CL2 is a clearance gap formed on a side closer to the back panel 1*b* than the first clearance gap CL1, and has a width greater than the width of the first clearance gap CL1. As illustrated in FIG. 4, the second clearance gap CL2 corresponds to, for example, a clearance gap formed between each of the seventh through ninth ones of the fins 32 as viewed from the front panel 1*a* to the back panel 1*b*, and the electric component box 5.

Figure 5:
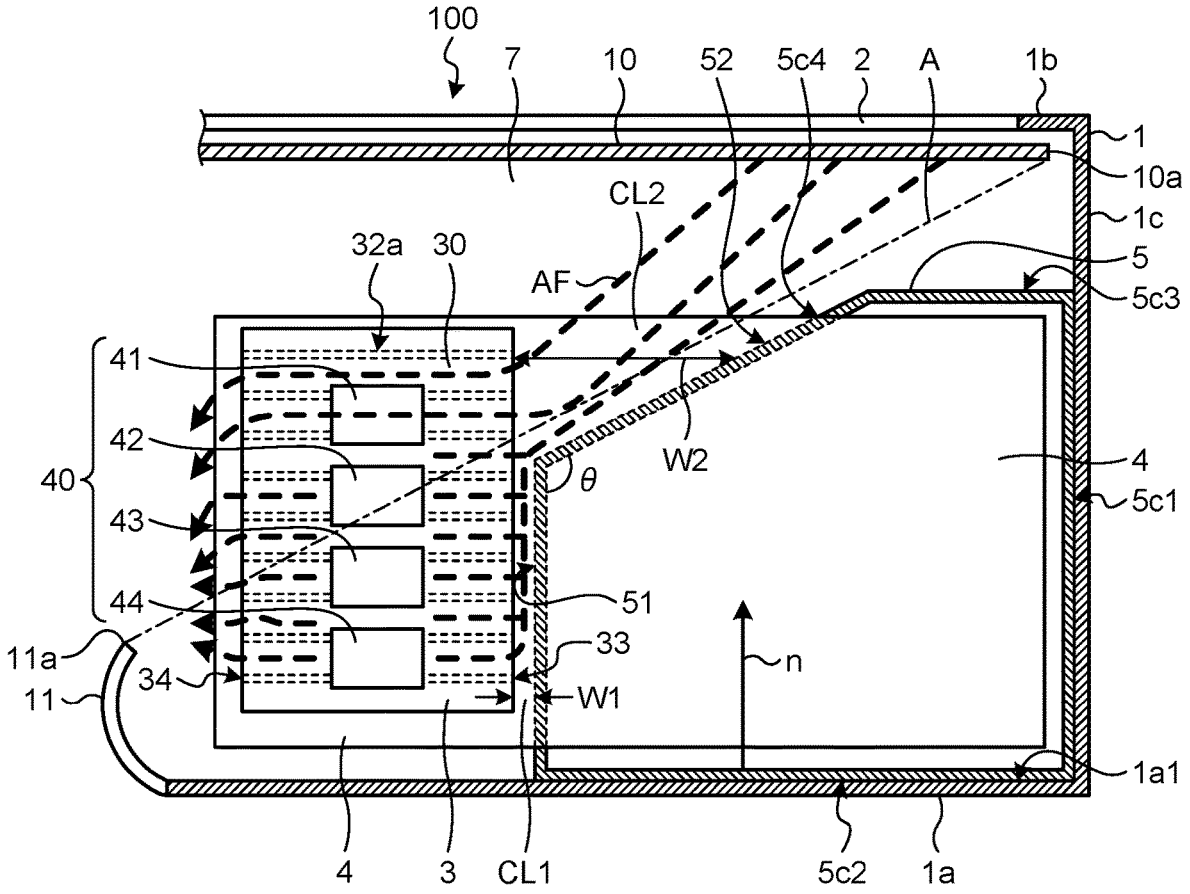
FIG. 5 is a view for describing a situation in which an airflow generated upon rotation of a blower illustrated in FIG. 2 passes through the heat dissipator illustrated in FIG. 4.

FIG. 5 is a view for describing a situation in which an airflow generated upon rotation of the blower illustrated in FIG. 2 passes through the heat dissipator illustrated in FIG. 4. Upon operation of at least one of the compressor 8 and the blower 6 illustrated in FIG. 2 in the outdoor unit 100, heat generated in the multiple electric components 40 is transferred to the base 31 and the fins 32 of the heat dissipator 3. In addition, rotation of the blower 6 causes, as illustrated in FIG. 5, air outside the housing 1 to be taken inside the housing 1 through the heat exchanger 10. This generates the airflow AF in the housing 1. The air having passed through the heat exchanger 10 is likely to flow along the shortest path from the heat exchanger 10 to the bell mouth 11. This causes an airflow AF generated in a region closer to the heat exchanger 10 than the vertical cross section including the imaginary line A to have a velocity greater than the velocity of an airflow AF generated in a region closer to the electric component box 5 than that cross section.

The outdoor unit 100 according to the first embodiment is configured such that a part of the heat dissipator 3 is set in a region closer to the heat exchanger 10 than the imaginary line A. In addition, the second counter-surface 52 of the electric component box 5 facing the heat dissipator 3 is inclined to form the second clearance gap CL2. Therefore, the airflow AF near the imaginary line A passes through the second clearance gap CL2 without interference from the electric component box 5.

Most of the air having passed through the second clearance gap CL2 reaches the first ends 33 of the heat dissipator 3 situated in the region closer to the heat exchanger 10 than the imaginary line A, and then flows into the air passages 30. In addition, a part of the air having passed through the second clearance gap CL2 passes through the first clearance gap CL1, reaches the first ends 33 of the heat dissipator 3 situated in the region closer to the front panel 1*a* than the imaginary line A, and then flows into the air passages 30.

Thus, passage of air through the air passages 30 formed in the heat dissipator 3 results in heat exchange performed between the heat dissipator 3 and the air, thereby causing the heat dissipator 3 to be cooled. Cooling of the heat dissipator 3 then cools the electric components 40 thermally connected with the heat dissipator 3.

As described above, the outdoor unit disclosed in Patent Literature 1 has the electric component box provided in a space between the compressor chamber and the top panel, and the heat dissipator provided in a space between the heat exchanger provided on the back panel side of the housing and the electric component box. Accordingly, the size of the housing needs to be increased so as to improve cooling efficiency of the heat dissipator.

In contrast, the outdoor unit 100 according to the first embodiment has the heat dissipator 3 provided in a space between the blower 6 and the electric component box 5, and is configured such that the clearance gap between the electric component box 5 and the heat dissipator 3 has a width gradually increasing from the front panel 1*a* toward the back panel 1*b* of the housing 1. Thus, the outdoor unit 100 allows the heat dissipator 3 to be disposed to use a space between the blower 6 and the electric component box 5. This can cause a width from the end of the heat dissipator 3 closer to the front panel 1*a* to the end of the heat dissipator 3 closer to the back panel 1*b* of the housing 1 to be made wider than the heat dissipator disclosed in the technique of Patent Literature 1, without increasing the width of the housing 1 in the depth direction. This achieves an increased surface area of the heat dissipator 3, which in turn increases the amount of heat exchange in the heat dissipator 3, and thereby improves cooling efficiency of each of the first electric component 41 through the fourth electric component 44.

Figure 6:
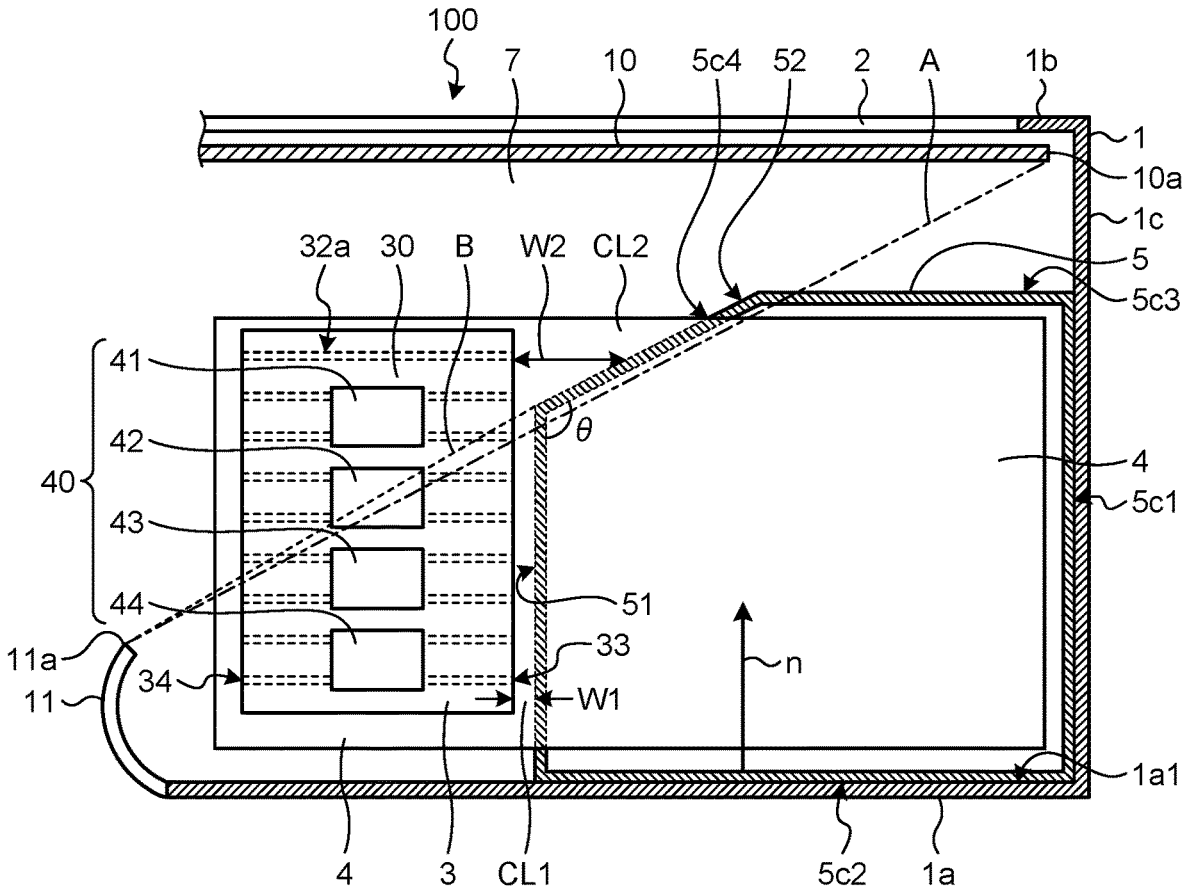
FIG. 6 is a view illustrating a variation of an electric component box illustrated in FIG. 1.

Note that it is sufficient that the airflow AF near the imaginary line A passes through the second clearance gap CL2 without interference from the electric component box 5, and reaches the first ends 33 of the heat dissipator 3 situated in the region closer to the heat exchanger 10 than the imaginary line A. Therefore, the second counter-surface 52 of the electric component box 5 may have a part thereof situated closer to the back panel 1*b* of the housing 1 than the vertical cross section including the imaginary line A. FIG. 6 is a view illustrating a variation of the electric component box illustrated in FIG. 1. The electric component box 5 illustrated in FIG. 6 is configured such that the second counter-surface 52 of the electric component box 5 is situated closer to the back panel 1*b* of the housing 1 than the vertical cross section including the imaginary line A. Even when the electric component box 5 is configured as described above, the heat dissipator 3 can be cooled using a flow of air having passed through a region near an end of the heat exchanger 10 as long as a part of the heat dissipator 3 is set closer to the back panel 1*b* of the housing 1 than a vertical cross section including an imaginary line B. The imaginary line B is, for example, a virtual line connecting most directly between the end 11*a* of the bell mouth 11 and the second counter-surface 52 of the electric component box 5.

Note that the second counter-surface 52 of the electric component box 5 illustrated in FIGS. 5 and 6 is not limited to a flat angled surface having no projections or recesses, and may also be a convex curved surface projecting toward the outside of the compressor chamber 9 as long as the airflow AF near the imaginary line A is allowed to reach the first ends 33 of the heat dissipator 3 without interference from the electric component box 5. In a case where the second counter-surface 52 of the electric component box 5 is a flat angled surface as in the outdoor unit 100 according to the first embodiment, a bending process of the electric component box 5 is simplified and thus manufacturing process of the electric component box 5 is simplified as compared to a case where the second counter-surface 52 has a curved shape.

Figure 7:
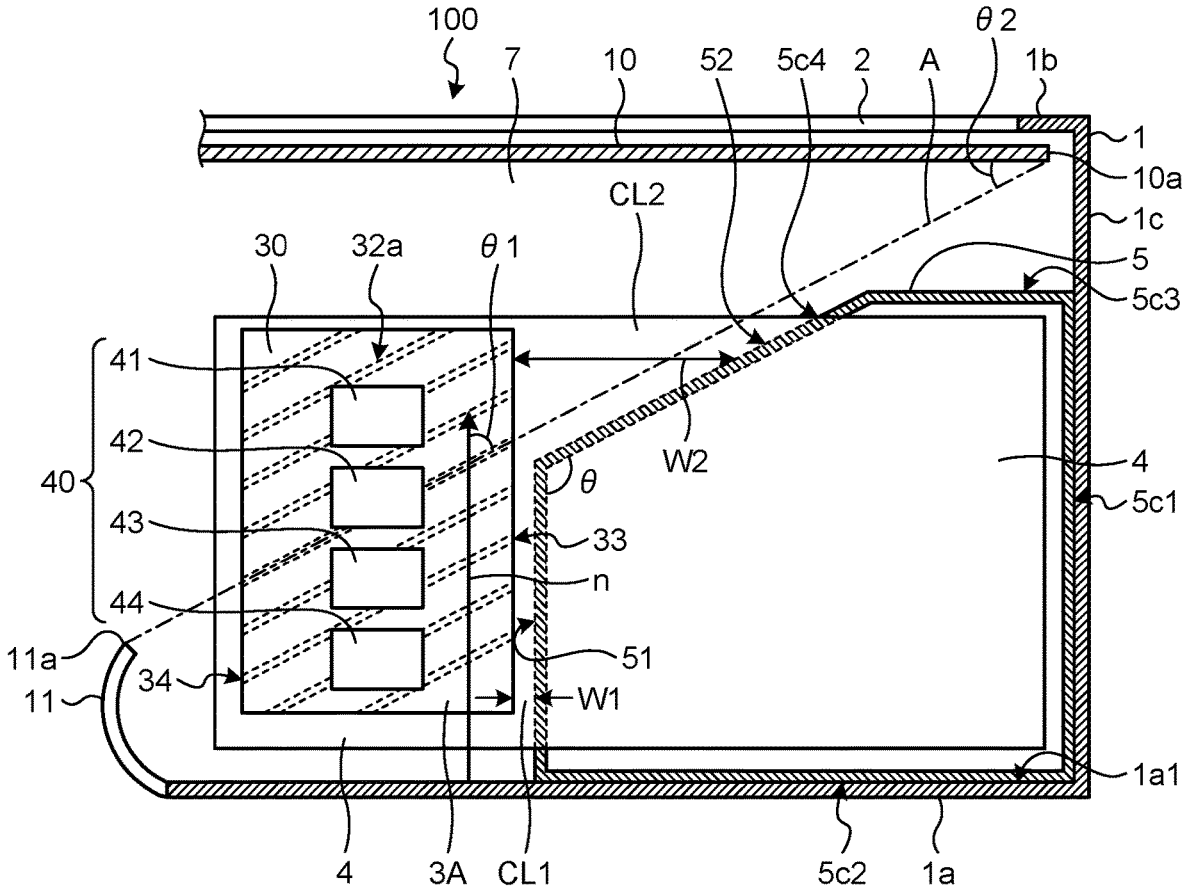
FIG. 7 is a view illustrating a first variation of the heat dissipator illustrated in FIG. 4.

FIG. 7 is a view illustrating a first variation of the heat dissipator illustrated in FIG. 4. In the heat dissipator 3 illustrated in FIGS. 5 and 6, the multiple fins 32 are arranged such that the heat-dissipating surface 32*a* of each of the multiple fins 32 is parallel with the front panel 1*a*. In contrast, the multiple fins 32 provided in a heat dissipator 3A according to the first variation illustrated in FIG. 7 are configured to have the heat-dissipating surfaces 32*a* being angled at a constant angle θ1 with respect to the normal n. The constant angle θ1 of the multiple fins 32 provided in the heat dissipator 3A is any angle in a range from 1° to 89°, but is desirably equal to an angle θ2 between the surface closer to the heat dissipator 3A, of the heat exchanger 10 provided on the back panel 1*b* of the housing 1 and the vertical cross section including the imaginary line A. Use of the multiple fins 32 arranged in this way to have the constant angle θ1 equal to the angle θ2 results in an increase in the opening area on the windward side of each of the air passages 30, thereby facilitating flowing of the airflow AF into the air passages 30 as compared to the case of use of the heat dissipator 3 illustrated in FIG. 4. Therefore, as compared to the case of use of the heat dissipator 3 illustrated in FIG. 4, the velocity of the airflow AF flowing through the air passages 30 is increased, which in turn increases the amount of heat exchange, and further improves cooling efficiency of each of the first electric component 41 through the fourth electric component 44.

Note that, in the first embodiment, the multiple electric components 40 are arranged spaced apart from each other along an extension direction of the normal n illustrated in FIG. 4, for example. When the multiple electric components 40 are arranged in this manner, heat generated in each of the multiple electric components 40 is transferred dispersedly to the multiple fins 32 as compared to a case where the multiple electric components 40 are arranged along a direction perpendicular to the normal n illustrated in FIG. 4.

In contrast, for example, in the case where the first electric component 41 through the fourth electric component 44 are linearly arranged along a direction perpendicular to the normal n to bridge between the second and third ones of the fins 32 as viewed from the back panel 1*b* side in FIG. 4, most of the heat generated in each of the first electric component 41 through the fourth electric component 44 is transferred to the above-mentioned two fins 32. For this reason, if, for example, the first electric component 41 generates more heat than the fourth electric component 44, the heat generated in the first electric component 41 is readily transferred to the fourth electric component 44 through the above-mentioned two fins 32, thereby leading to a possibility that a temperature of the fourth electric component 44 becomes higher than a temperature when the fourth electric component 44 operates solely. In addition, since the remaining fins 32 other than the above-mentioned two fins 32 are situated away from the first electric component 41 through the fourth electric component 44, the remaining fins 32 become less likely to contribute to cooling of the first electric component 41 through the fourth electric component 44.

The heat dissipator 3 according to the first embodiment is configured such that the multiple electric components 40 are arranged spaced apart from each other along the arrangement direction of the multiple fins 32. This configuration allows the heat generated in each of the multiple electric components 40 to be transferred dispersedly to the multiple fins 32, thereby enabling the multiple electric components 40 to be effectively cooled. In addition, the heat dissipator 3 according to the first embodiment is less likely to allow the heat generated in the first electric component 41 to be transferred to the fourth electric component 44, thereby making it possible to prevent the fourth electric component 44 from failing due to a high temperature thereon.

Figure 8:
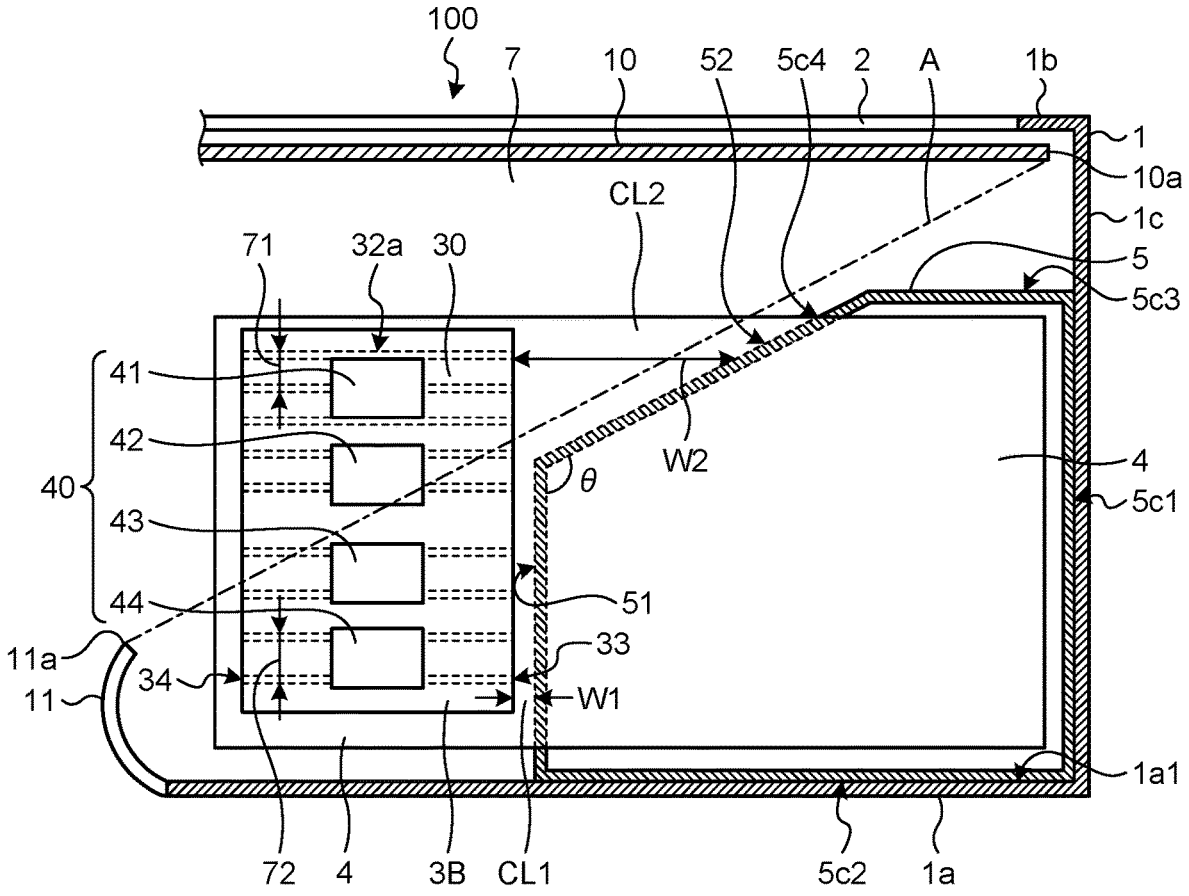
FIG. 8 is a view illustrating a second variation of the heat dissipator illustrated in FIG. 4.

FIG. 8 is a view illustrating a second variation of the heat dissipator illustrated in FIG. 4. A heat dissipator 3B according to the second variation illustrated in FIG. 8 is configured such that a first fin pitch 71 is shorter than a second fin pitch 72. The first fin pitch 71 is equal to a fin-to-fin width in the arrangement direction of the multiple fins provided in the region closer to the back panel 1*b* than the vertical cross section including the imaginary line A. The second fin pitch 72 is equal to a fin-to-fin width in the arrangement direction of the multiple fins provided in the region closer to the front panel 1*a* than the vertical cross section including the imaginary line A.

Use of the first fin pitch 71 shorter than the second fin pitch 72 enables the surface area of the fins provided in the region closer to the back panel 1*b* than the imaginary line A to be greater than the surface area of the fins provided in the region closer to the front panel 1*a* than the imaginary line A. This can increase the amount of heat exchange in the fins provided in the region closer to the back panel 1*b* than the imaginary line A, thereby further improving cooling efficiency of, for example, each of the first electric component 41 and the second electric component 42.

In addition, for example, in the case where the first electric component 41 is disposed closer to the back panel 1*b* than the imaginary line A and the third electric component 43 is disposed closer to the front panel 1*a* than the imaginary line A, the heat dissipator 3B can improve cooling efficiency of the first electric component 41 as compared to the case where the first electric component 41 is disposed closer to the front panel 1*a* than the imaginary line A and the third electric component 43 is disposed closer to the back panel 1*b* than the imaginary line A. Moreover, the amount of use of the material from which the fins 32 are made is reduced as compared to the case where all the fins 32 are arranged with the first fin pitch 71, thereby enabling the manufacturing cost of the heat dissipator 3B to be reduced.

Furthermore, use of the second fin pitch 72 greater than the first fin pitch 71 in the heat dissipator 3B prevents stagnation of the airflow AF in the air passages 30 formed by the fins 32 arranged with the second fin pitch 72 even when the velocity of the airflow AF passing through the second clearance gap CL2 illustrated in FIG. 4 is lower than the velocity of the airflow AF passing through the first clearance gap CL1. This can prevent a decrease in heat dissipation efficiency for the third electric component 43 or the like that generates less heat.

Figure 9:
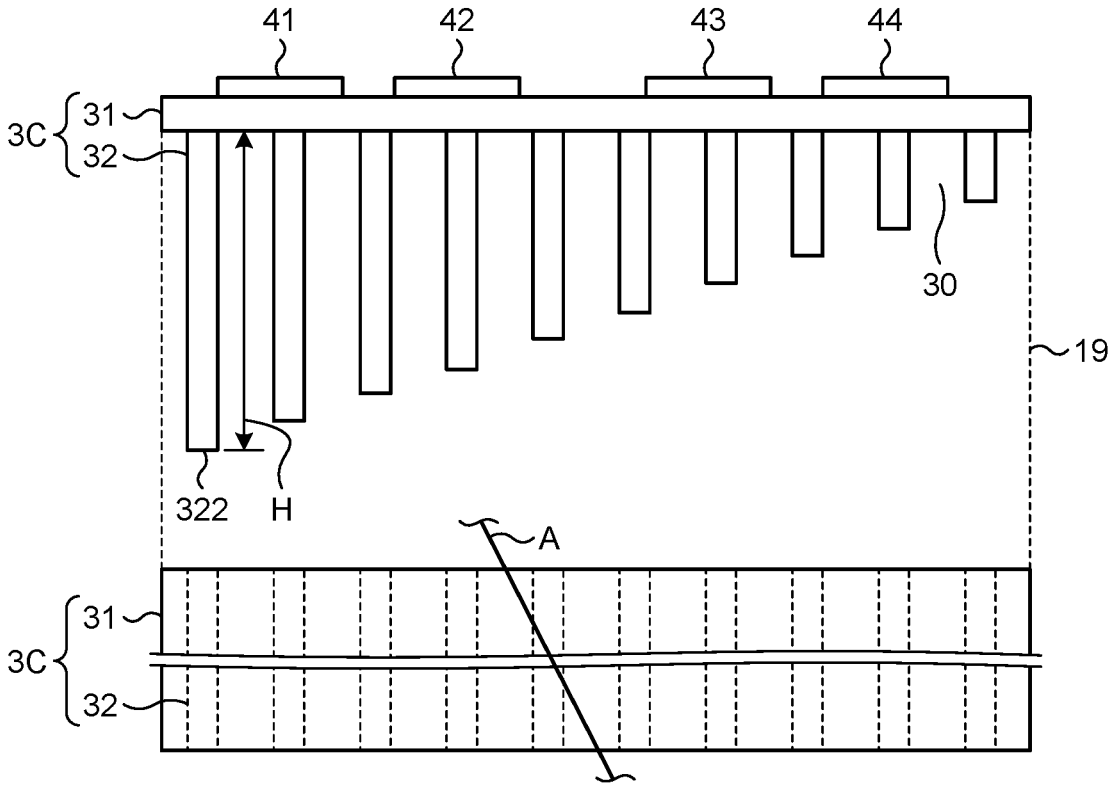
FIG. 9 is a view illustrating a third variation of the heat dissipator illustrated in FIG. 4.

FIG. 9 is a view illustrating a third variation of the heat dissipator illustrated in FIG. 4. The upper portion of FIG. 9 illustrates a heat dissipator 3C according to the third variation as viewed from the second side panel 1*d* to the first side panel 1*c* illustrated in FIG. 1. The lower portion of FIG. 9 illustrates the heat dissipator 3C according to the third variation as viewed from the top panel 1*f* to the bottom panel 1*e* illustrated in FIG. 1. The heat dissipator 3C is configured to have a height H from the base 31 to a leading edge 322 of the fin 32 increasing from the front panel 1*a* toward the back panel 1*b* illustrated in FIG. 4. As illustrated in FIG. 9, the height H of the fins 32 disposed closer to the back panel 1*b* than the imaginary line A is greater than the height H of the fins 32 disposed closer to the front panel 1*a* than the imaginary line A. Accordingly, the surface area of the fins 32 disposed closer to the back panel 1*b* than the imaginary line A is greater than the surface area of the fins 32 disposed closer to the front panel 1*a* than the imaginary line A. In this way, difference in the height H of the fins 32 can prevent an increase in the amount of use of the material from which the fins 32 are made while improving cooling efficiency of, for example, the first electric component 41 that generates more heat.

In addition, the heat dissipator 3C prevents stagnation of the airflow AF in the air passages 30 formed by the fins 32 disposed closer to the front panel 1*a* than the imaginary line A even when the velocity of the airflow AF having passed through the second clearance gap CL2 illustrated in FIG. 4 is lower than the velocity of the airflow AF having passed through the first clearance gap CL1. This can prevent a decrease in heat dissipation efficiency for the third electric component 43 or the like that generates less heat.

Note that the structure of the heat dissipator 3C illustrated in FIG. 9 may be combined with the structure of the heat dissipator 3B illustrated in FIG. 8. For example, the heat dissipator 3C illustrated in FIG. 9 may be configured such that the fins 32 disposed closer to the front panel 1*a* than the imaginary line A are arranged with the first fin pitch 71 and the fins 32 disposed closer to the back panel 1*b* than the imaginary line A are arranged with the second fin pitch 72.

In addition, in the case where at least one of the multiple electric components 40 used in the outdoor unit 100 according to the first embodiment is a semiconductor device, one example of that semiconductor device can be a metal-oxide-semiconductor field-effect transistor (MOSFET) made from a silicon-based material. Moreover, such a semiconductor device may also be a MOSFET made from a wide bandgap semiconductor such as silicon carbide, gallium nitride, gallium oxide, or diamond.

A wide bandgap semiconductor generally has higher voltage resistance and higher heat resistance than a silicon semiconductor. Therefore, use of a wide bandgap semiconductor for a semiconductor device raises voltage resistance and permissible current density of the semiconductor device, and can thus achieve a size reduction of a semiconductor module incorporating the semiconductor device. In addition, a wide bandgap semiconductor has high heat resistance, and can therefore provide a size reduction of a heat dissipator for dissipating heat generated in the semiconductor module, and also can simplify the heat-dissipating structure for dissipating the heat generated in the semiconductor module.

Moreover, a wide bandgap semiconductor generates less heat than a silicon semiconductor. Therefore, when a wide bandgap semiconductor is used in the electric component 40 of the outdoor unit 100 installed in, for example, a place or region likely to be subjected to a high temperature such as a factory or a low latitude region, the heat generated in the electric component 40 is prevented from increasing. This can extend the life of, for example, an electrolytic capacitor being placed near a heat-generating component, and can thus improve reliability of the outdoor unit 100.

Second Embodiment

Figure 10:
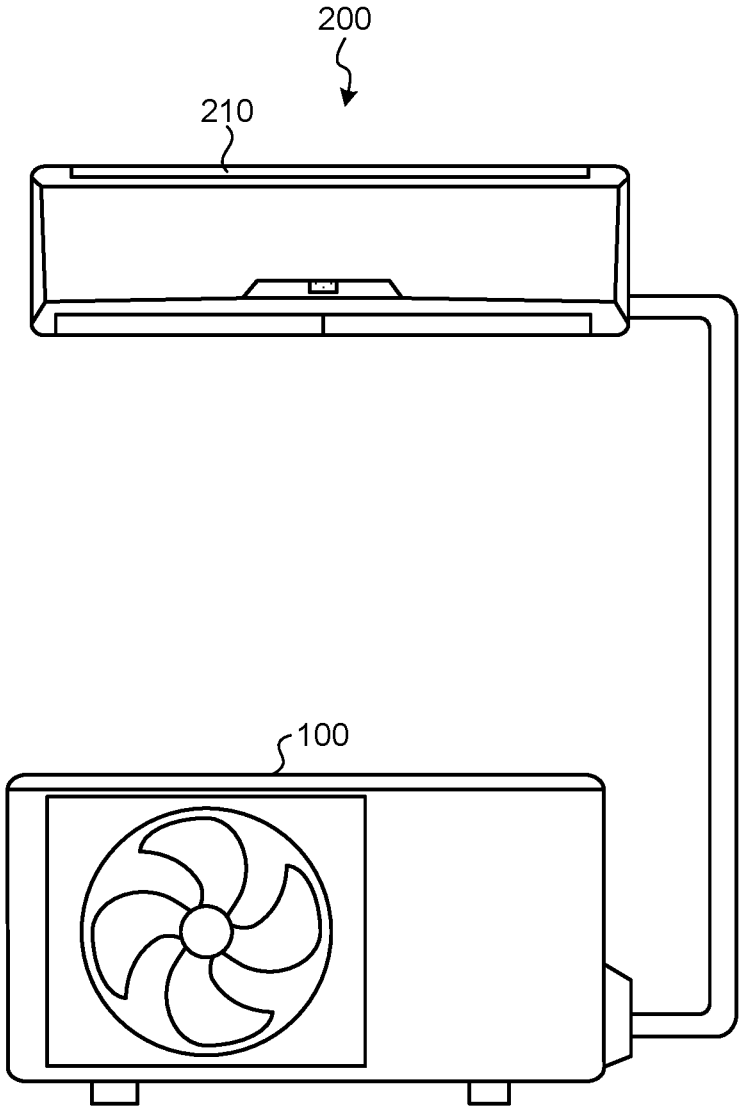
FIG. 10 is a view illustrating an example configuration of an air conditioner according to a second embodiment of the present invention.

FIG. 10 is a view illustrating an example configuration of an air conditioner according to a second embodiment of the present invention. An air conditioner 200 includes the outdoor unit 100 according to the first embodiment and an indoor unit 210 connected to the outdoor unit 100. Use of the outdoor unit 100 according to the first embodiment can lead to a possibility to provide the air conditioner 200 that is capable of achieving a size reduction of the housing 1 while improving cooling efficiency of the heat dissipator 3 illustrated in FIG. 4 and more. Improvement of cooling efficiency of the heat dissipator 3 in turn enables a highly-reliable air conditioner 200 to be provided.

Note that, in the outdoor unit 100 according to the present embodiment, the substrate 4 is provided such that a part thereof protrudes out of the electric component box 5, but the substrate 4 protruding outside the electric component box 5 may be covered with a part of the electric component box 5 so as to prevent grit and dust from adhering on the electric component 40.

Besides, although the outdoor unit 100 according to the present embodiment has the fins 32 disposed, as illustrated in FIG. 4, at positions apart by a certain distance from the first counter-surface 51 of the electric component box 5, the heat dissipator 3 may be set such that the fins 32 come into contact with the first counter-surface 51 of the electric component box 5. That is, the heat dissipator 3 may be set so that the first clearance gap CL1 is zero. Even in such configuration, passage of air through the air passages 30 formed in the fins 32 facing the second counter-surface 52 of the electric component box 5 allows the heat dissipator 3 to be cooled, and thus enables the electric components 40 to be cooled.

The configurations described in the foregoing embodiments are merely examples of various aspects of the present invention. These configurations may be combined with other publicly known techniques, and each partially omitted and/or modified without departing from the scope of the present invention.

The invention claimed is:

1. An outdoor unit comprising:

a blower to generate an airflow;

a housing having a front panel, a back panel, a first side panel, a second side panel, a top panel, and a bottom panel, the front panel having an outlet through which the airflow passes, the back panel being situated on an opposite side of the front panel, the second side panel being situated on an opposite side of the first side panel, the bottom panel being situated on an opposite side of the top panel, the blower being disposed in the housing;

a heat exchanger provided to a rear side of the housing;

an electric component box provided between the heat exchanger and the front panel;

a substrate having an electric component provided thereon, the substrate extending from the electric component box toward the second side panel; and a heat dissipator provided between the electric component box and the blower, and thermally connected to the electric component provided on the substrate, the heat dissipator comprising a plurality of fins that are arranged spaced apart from each other in a direction from the front panel to the back panel, an air passage being formed between adjacent ones of the fins, the fins each having an end situated on a windward side of the air passage, the end facing the electric component box, wherein when the heat dissipator and the electric component box are viewed from above, a first clearance gap having a first width and a second clearance gap having a second width greater than the first width are formed between the end and the electric component box, the second clearance gap being closer to the back panel than the first clearance gap.

2. The outdoor unit according to claim 1, wherein the electric component box includes a first counter-surface by which the first clearance gap is defined and a second counter-surface by which the second clearance gap is defined.

3. The outdoor unit according to claim 2, wherein when the first counter-surface and the second counter-surface are viewed from above, the second counter-surface is an angled surface angled at a constant angle with respect to an extension direction of the first counter-surface.

4. The outdoor unit according to claim 2, comprising: a bell mouth having an annular shape, which is provided on the front panel and projects from an annular wall surface forming the outlet into an inside of the housing, wherein the second counter-surface is set closer to the front panel than a vertical cross section including an imaginary line connecting most directly between an end of the bell mouth closer to the back panel and an end of the heat exchanger closer to the first side panel, and at least a part of the heat dissipator is set closer to the back panel than the vertical cross section including the imaginary line.

5. The outdoor unit according to claim 1, wherein the fins are arranged so that a counter-surface of each of adjacent ones of the fins is angled at a constant angle with respect to a normal perpendicular to an inner surface of the front panel.

6. The outdoor unit according to claim 1, wherein the heat dissipator has a width in a direction from the front panel to the back panel being smaller than a width in a direction from the first side panel to the second side panel.

7. The outdoor unit according to claim 1, wherein multiple ones of the electric component are arranged on the heat dissipator along a normal perpendicular to an inner surface of the front panel, with the ones being spaced apart from each other.

8. The outdoor unit according to claim 4, wherein the heat dissipator is configured such that multiple ones of the fins provided in a region closer to the back panel than the vertical cross section including the imaginary line are arranged with a first fin pitch, and multiple ones of the fins provided in a region closer to the front panel than the vertical cross section including the imaginary line are arranged with a second fin pitch, the first fin pitch being less than the second fin pitch.

9. The outdoor unit according to claim 1, wherein the heat dissipator is configured such that heights of the fins increase from the front panel toward the back panel.

10. The outdoor unit according to claim 1, wherein the electric component is a semiconductor device made from a wide bandgap semiconductor.

11. An air conditioner comprising:

the outdoor unit according to claim 1; and an indoor unit.

12. The air conditioner according to claim 11, wherein the electric component box includes a first counter-surface by which the first clearance gap is defined and a second counter-surface by which the second clearance gap is defined.

13. The air conditioner according to claim 12, wherein when the first counter-surface and the second counter-surface are viewed from above, the second counter-surface is an angled surface angled at a constant angle with respect to an extension direction of the first counter-surface.

14. The air conditioner according to claim 12, comprising: a bell mouth having an annular shape, which is provided on the front panel and projects from an annular wall surface forming the outlet into an inside of the housing, wherein the second counter-surface is set closer to the front panel than a vertical cross section including an imaginary line connecting most directly between an end of the bell mouth closer to the back panel and an end of the heat exchanger closer to the first side panel, and at least a part of the heat dissipator is set closer to the back panel than the vertical cross section including the imaginary line.

15. The air conditioner according to claim 11, wherein the fins are arranged so that a counter-surface of each of adjacent ones of the fins is angled at a constant angle with respect to a normal perpendicular to an inner surface of the front panel.

16. The air conditioner according to claim 11, wherein the heat dissipator has a width in a direction from the front panel to the back panel being smaller than a width in a direction from the first side panel to the second side panel.

17. The air conditioner according to claim 11, wherein multiple ones of the electric component are arranged on the heat dissipator along a normal perpendicular to an inner surface of the front panel, with the ones being spaced apart from each other.

18. The air conditioner according to claim 14, wherein the heat dissipator is configured such that multiple ones of the fins provided in a region closer to the back panel than the vertical cross section including the imaginary line are arranged with a first fin pitch, and multiple ones of the fins provided in a region closer to the front panel than the vertical cross section including the imaginary line are arranged with a second fin pitch, the first fin pitch being less than the second fin pitch.

19. The air conditioner according to claim 11, wherein the heat dissipator is configured such that heights of the fins increase from the front panel toward the back panel.

20. The air conditioner according to claim 11, wherein the electric component is a semiconductor device made from a wide bandgap semiconductor.

* * * * *